US005710966A

United States Patent [19]

Otsuka et al.

[11] Patent Number: 5,710,966

[45] Date of Patent: Jan. 20, 1998

[54] CLEANING DEVICE FOR REMOVING NON-TRANSFERRED TONER

[75] Inventors: Yasuhiro Otsuka; Masakazu Okuda, both of Tokyo, Japan

[73] Assignee: NEC Corporation, Tokyo, Japan

[21] Appl. No.: 550,305

[22] Filed: Oct. 30, 1995

[30] Foreign Application Priority Data

Oct. 31, 1994 [JP] Japan ..... 6-266854

[51] Int. Cl.[6] ..... G03G 21/00

[52] U.S. Cl. ..... 399/343; 399/350

[58] Field of Search ..... 355/296, 299, 355/297, 303; 15/256.5; 399/343, 350

[56] References Cited

U.S. PATENT DOCUMENTS

| | | | |
|---|---|---|---|
| 3,824,098 | 7/1974 | Bergman, Jr. et al. . | |
| 3,879,785 | 4/1975 | Roth et al. | 355/297 X |
| 3,935,327 | 1/1976 | Taylor . | |
| 4,111,546 | 9/1978 | Maret | 355/297 |
| 4,260,243 | 4/1981 | Dolan et al. . | |
| 5,065,194 | 11/1991 | Sonnenberg | 355/296 |
| 5,185,619 | 2/1993 | Snelling . | |
| 5,264,903 | 11/1993 | Nagame et al. | 355/297 |
| 5,276,484 | 1/1994 | Snelling | 355/211 |
| 5,282,005 | 1/1994 | Nowak et al. | 355/296 X |

FOREIGN PATENT DOCUMENTS

| | | |
|---|---|---|
| 0323143 | 7/1989 | European Pat. Off. . |
| 0404491 | 12/1990 | European Pat. Off. . |
| 0490642 | 6/1992 | European Pat. Off. . |
| 56-158350 | 12/1981 | Japan . |
| 60-119575 | 6/1985 | Japan . |
| 2-033155 | 7/1988 | Japan . |
| 1-161370 | 6/1989 | Japan . |
| 3-212658 | 9/1991 | Japan . |
| 5-289537 | 11/1993 | Japan . |
| 5-307346 | 11/1993 | Japan . |
| 6-186885 | 7/1994 | Japan . |

*Primary Examiner*—Nestor R. Ramirez

*Attorney, Agent, or Firm*—Ostrolenk, Faber, Gerb & Soffen, LLP

[57] ABSTRACT

A cleaning device includes a removing portion and a heater. The removing portion removes a toner held by an electrostatic force on a first surface of a latent image charge holding member. The latent image charge holding member includes a pyroelectric layer having a first surface on which the toner is deposited. The heater heats the pyroelectric layer to reduce the electrostatic force attracting the toner to the first surface of the pyroelectric layer, and the removing portion thereby removes the toner from the latent image charge holding member. In another embodiment of the cleaning device, the heater is incorporated in the removing portion which is a blade. In still another embodiment the cleaning device includes a heater and an ultrasonic vibrator is used as the removing portion.

7 Claims, 5 Drawing Sheets

CLEANING DEVICE FOR REMOVING NON-TRANSFERRED TONER

BACKGROUND OF THE INVENTION

The present invention relates to a cleaning device for removing a non-transferred toner and, more particularly, to a cleaning device for removing a non-transferred toner remaining on a latent image charge holding member in an image recording apparatus such as a printer, a facsimile system, or a copying machine.

As image recording apparatuses for forming an image by forming a latent image on a latent image charge holding member using a pyroelectric effect, developing the latent image using a charged marking particles, and transferring/fixing the developed image onto a recording member, the apparatuses disclosed in U.S. Pat. Nos. 3,824,098 and 3,935,327, Japanese Patent Laid-Open Nos. 56-158350 and 60-119575, U.S. Pat. No. 5,185,619 (Japanese Patent Laid-Open No. 5-134506), and the like are known. In the descriptions of these conventional image recording apparatuses, no reference is made to a cleaning device for removing a non-transferred marking particles remaining on a latent image charge holding member after a marking particles attracted to the latent image charge holding member with an electrostatic force is transferred onto a recording member.

In the descriptions of the image forming apparatuses disclosed in Japanese Patent Laid-Open Nos. 1-161370 and 3-212658, a cleaning device having the same structure as that of a cleaning device in an electrophotographic image recording apparatus is disclosed. That is, a cleaning device for mechanically scraping a charged marking particles (toner) from a latent image charge holding member with a blade or brush pressed against the latent image charge holding member is disclosed.

In a cleaning device for removing a charged marking particles from a latent image charge holding member by mechanically scraping it therefrom using a blade or brush, a force exceeding the attraction between the charged marking particles and the latent image charge holding member must be applied to the charged marking particles attracted thereto with a blade or brush.

In general, a charged marking particles used for image recording, like a powder toner, is a mass of a fine particles each having a diameter of about 10 μm. These fine particles are firmly attracted to the latent image charge holding member with an electrostatic force. It is therefore not easily to completely remove many fine particles of a charged marking particles (to be referred to as a toner hereinafter) attracted to the latent image charge holding member. For this reason, a toner tends to remain on the latent image charge holding member even after the member passes through the cleaning device. In the above conventional device, as a toner decreases in size and its shape approaches a spherical shape, a cleaning operation is made more difficult.

SUMMARY OF THE INVENTION

It is an object of the present invention to provide a highly reliable cleaning device which can effectively scrape a residual toner from a latent image charge holding member.

In order to achieve the above object, according to the present invention, there is provided a cleaning device comprising removing means for removing a toner held on a first surface of a latent image charge holding member with an electrostatic force therefrom, the first surface having a pyroelectric layer formed thereon, and heating means for heating the pyroelectric layer in removing the toner from the latent image charge holding member.

DESCRIPTION OF THE PREFERRED EMBODIMENTS

[First Embodiment]

The first embodiment of the present invention will be described below with reference to FIGS. 1 to 2B.

Figure 1:
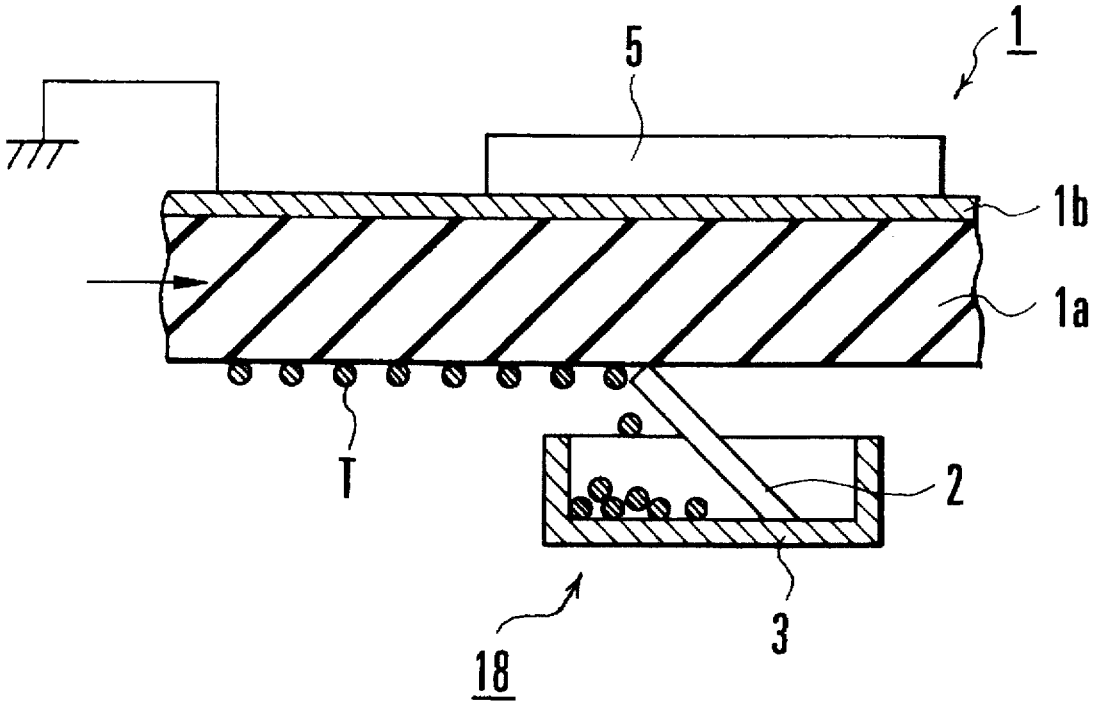
FIG. 1 is a schematic sectional view showing a cleaning device according to the first embodiment of the present invention.
Figure 2A:
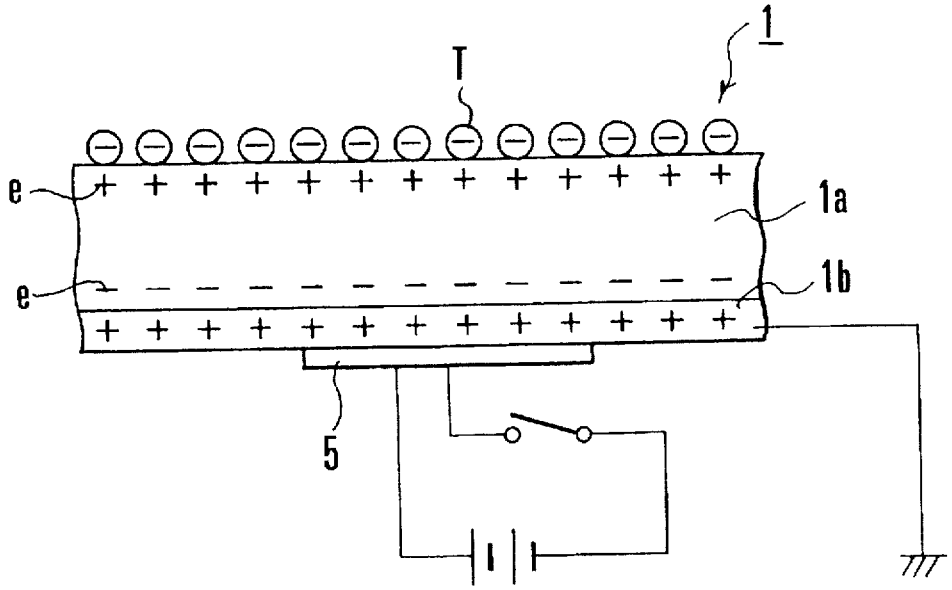
FIG. 2A is a view showing a state of the cleaning device in FIG. 1 before a heater generates heat.
Figure 2B:
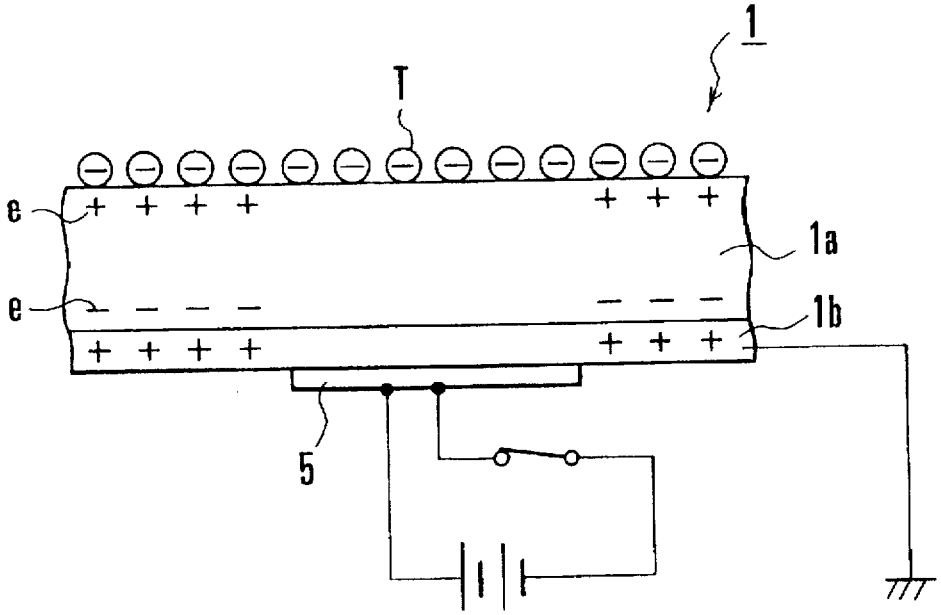
FIG. 2B is a view showing a state of the cleaning device after the heater generates heat.

The first embodiment shown in FIGS. 1 to 2B includes a silicone rubber blade 2 and a cleaning case 3. The blade 2 scrapes a toner T from a latent image charge holding member 1 having a pyroelectric layer 1*a* capable of holding polarization charges on its surface. The toner T is attracted to one surface of the latent image charge holding member 1 with an electrostatic force. The cleaning case 3 is used to store the toner T scraped by the blade 2. The blade 2 is pressed against the latent image charge holding member 1 with the elasticity of the silicone rubber. Reference numeral 1*b* denotes a conductive layer attached to the other surface of the pyroelectric layer 1*a*. The conductive layer 1*b* and the pyroelectric layer 1*a* constitute the latent image charge holding member 1 in the form of an endless belt.

The latent image charge holding member 1 has a heater 5 in the form of a thick plate, which is a heating means disposed in contact with the conductive layer 1*b* and adapted to heat the pyroelectric layer 1*a*.

The operation of the first embodiment in FIG. 1 will be described next with reference to FIGS. 2A and 2B.

Referring to FIGS. 2A and 2B, the pyroelectric layer 1*a* of the latent image charge holding member 1 has polarization charges +e and −e on one surface and the other surface, respectively, upon spontaneous polarization of molecules. The toner T is attracted to the surface of the latent image charge holding member 1 with an electrostatic force acting between the toner and the polarization charges +e.

When the latent image charge holding member 1 having the pyroelectric layer 1*a* is heated by the heater 5, the oriented state of the molecules in the pyroelectric layer 1*a* changes, and the amount polarization charges −e generated on the pyroelectric layer 1*a* decreases, as shown in FIG. 2B.

As a result, the attraction between the toner T and the latent image charge holding member 1 reduces.

As shown in FIG. 1, therefore, the toner T can be easily removed from the latent image charge holding member 1 by heating the latent image charge holding member 1, and mechanically scraping the toner T from the latent image charge holding member 1 with the latent image charge holding member 1 or the like in a state wherein the attraction between the latent image charge holding member 1 and the toner T is reduced.

In order to confirm the effect of the first embodiment in FIG. 1, an experiment on the removal of the toner T was conducted. More specifically, the powder toner T was attracted to the entire surface of the latent image charge holding member 1, and the toner T was then removed while the heating temperature of the heater 5 was variously changed. In this experiment, as the latent image charge holding member 1, a member obtained by depositing an aluminum film (Al film) as the conductive layer 1*b* on one surface of a PVDF (polyvinylidene fluoride) layer as the pyroelectric layer 1*a* was used. In addition, as the toner T, a fine spherical polymer toner with an average particle diameter of 5 μm was used.

The toner T was removed while the heating temperature of the heater 5 was changed to room temperature (25° C.), 60° C., and 80° C. When the heating temperature of the heater 5 was room temperature (25° C.), i.e., the heater 5 generated no heat, a large amount of toner T remaining on the latent image charge holding member 1 after the member passed through the cleaning device was easily observed with the naked eye.

When the heating temperature of the heater 5 was 60° C. the toner T could be removed to such an extent that the residual toner could not easily be observed with the naked eye. In observation with a microscope, the presence of a small amount of toner T was confirmed. In addition, when the heating temperature of the heater 5 was 80° C., the cleaning ability could be improved to a level at which the residual toner T could not easily be observed even with the microscope.

As described above, it was confirmed that a highly reliable cleaning device could be realized by a combination of the blade 2 as a conventional mechanical scraping mechanism and a heating means such as a heater. In this case, the heating temperature needs to be lower than at least the Curie point of the pyroelectric layer 1*a*. For example, the heating temperature is preferably set to be 80° C. or less when PVDF is to be used, in consideration of quality maintenance.

Figure 3:
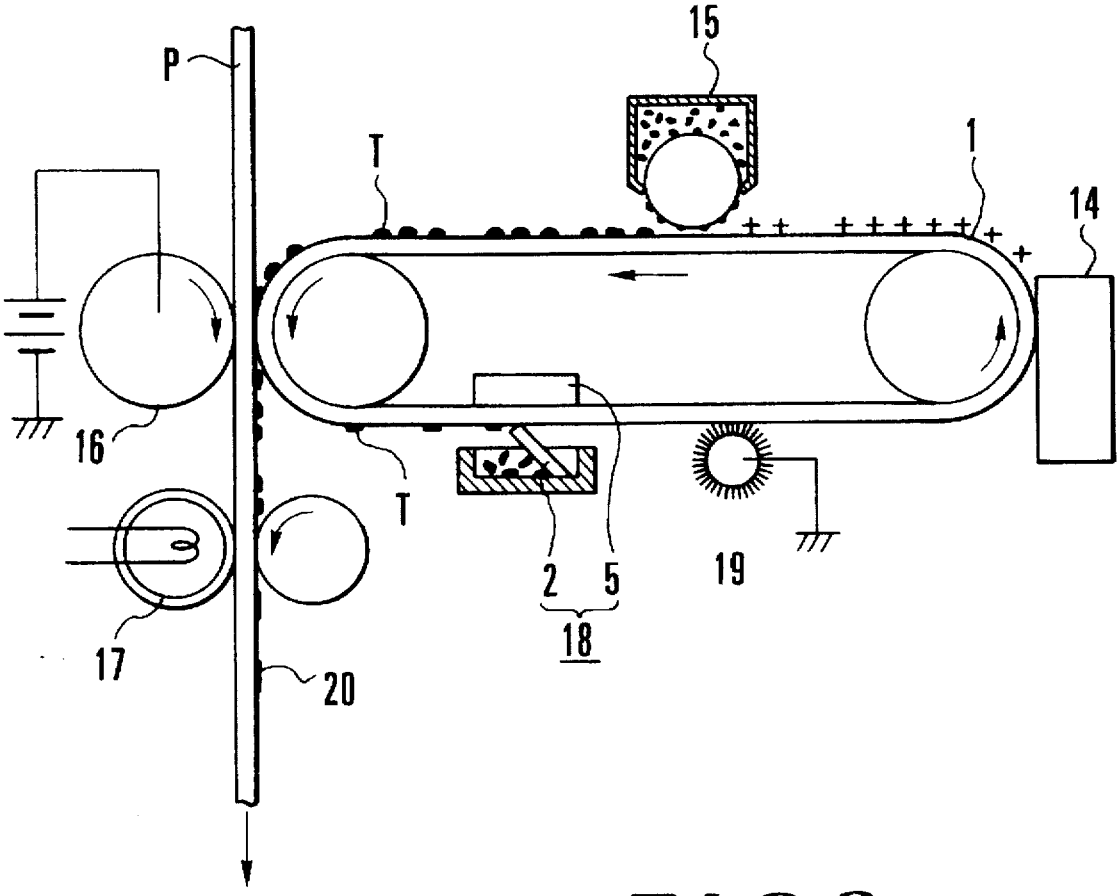
FIG. 3 is a schematic view showing an image recording apparatus having the cleaning device in FIG. 1.

A case will be described below, in which the cleaning device in FIG. 1 was mounted in an image forming apparatus, and an image recording operation was performed, as shown in FIG. 3.

The image forming apparatus in FIG. 3 includes the above latent image charge holding member 1 in the form of an endless belt, a thermal head 14 for forming an electrostatic latent image, a dry type toner developing unit 15 for developing the electrostatic latent image, a transfer unit 16 as a transfer means for a recording member (recording paper) P, a fixing unit 17 for fixing the transferred toner T, a cleaning device 18 having the blade 2 and the heater 5 and serving to remove the unnecessary residual toner T, a discharging brush 19 for discharging unnecessary charges, and the like.

As the latent image charge holding member 1, a belt constituted by a film in an endless form was used. The film was made of two layers, i.e., the pyroelectric layer 1*a* (a PVDF layer having a thickness of about 30 μm) and the conductive layer 1*b* (an Al deposition film having a thickness of about 500 Å). The latent image charge holding member 1 was selectively heated by the thermal head 14 in accordance with an image signal, and a latent image was formed by using a pyroelectric effect. Thereafter, toner development was performed by using the toner developing unit 15. As the toner T, spherical polymer toner having an average particle diameter of 5 μm was used.

The latent image charge holding member 1 having undergone development was superposed on the recording paper P as a recording member, and the toner T was electrostatically transferred onto the surface of the recording paper P. Thereafter, a toner image 20 was fixed onto the recording paper P by the fixing unit 17 using a heat roller. After the toner T was transferred onto the recording paper P, the latent image charge holding member 1 was conveyed to the latent image forming portion (thermal head) 14 again to execute the next latent image forming operation. Prior to this operation, removal of the non-transferred toner T remaining on the latent image charge holding member 1 and discharging (neutralization) of the latent image charge holding member 1 were performed by the cleaning device 18 and the discharging brush 19, respectively. In this experiment, this image recording operation was repeatedly performed a plurality of number of times.

In the image recording operation in FIG. 3, solid printing was performed in the odd-numbered operations, and no image data was supplied to the thermal head 14 to output blank paper in the even-numbered operations. The performance of the cleaning device 18 was evaluated from the blank paper output in the even-numbered operations.

If a cleaning operation is not sufficiently performed, the toner T remains even after the latent image charge holding member 1 passes through the cleaning device 18. As a result, the toner T is transferred, as noise, onto the recording paper P when blank paper is output in even-numbered operations. The presence/absence of the residual toner depending on the transfer of the toner was checked by using the above phenomenon.

When image recording was performed at room temperature (25° C.) without heating the cleaning device 18, a large amount of residual toner T was transferred onto the recording paper P in even-numbered blank paper outputting operations. The performance of the cleaning device 18 was evaluated in the same manner as described above while the heating temperature of the cleaning device 18 was gradually raised. As a result, it was confirmed that the amount of residual toner T transferred onto the recording paper P gradually decreased as the cleaning ability improved with a rise in heating temperature, and perfect blank paper could be obtained at heating temperatures of 45° C. to 55° C.

The optimal heating temperature of the cleaning device 18 changes depending on the arrangement of the device upon receiving influences of various factors such as the mechanical scraping ability of the blade 2 and the shape of the toner T. For this reason, the heating temperatures are not limited to 45° C. to 55° C.

[Second Embodiment]

Figure 4:
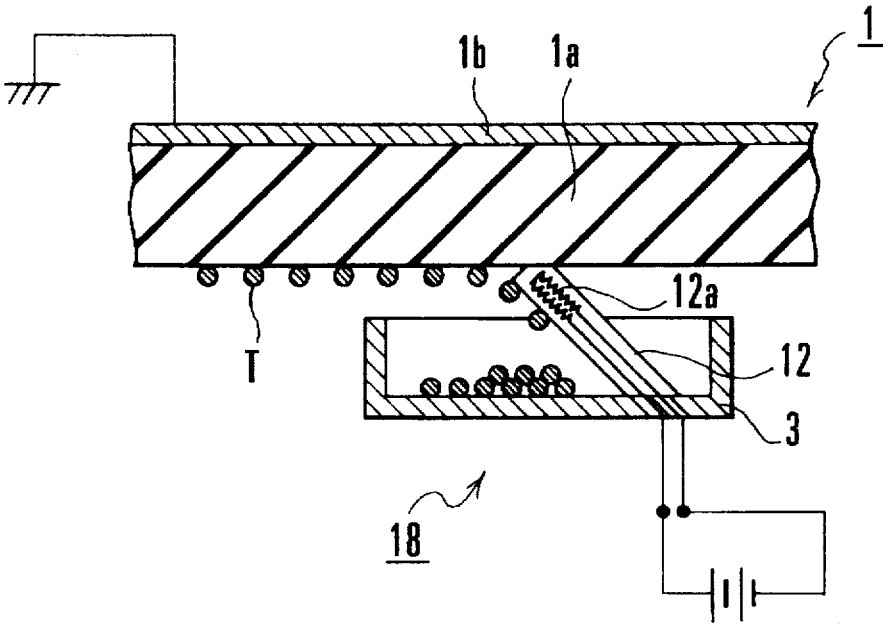
FIG. 4 is a schematic sectional view showing a cleaning device according to the second embodiment of the present invention.

FIG. 4 shows the second embodiment of the present invention. The second embodiment in FIG. 4 is characterized in that a heating resistive element is incorporated, as a heater 12*a*, in a blade 12. The remaining arrangement of the second embodiment is the same as that of the embodiment in FIG. 1.

In the second embodiment shown in FIG. 4, an experiment on the removal of a toner T as a charged marking particles was conducted in the same manner as in the first embodiment. That is, the toner T was attracted to the entire surface of a latent image charge holding member 1 with an electrostatic force, and the toner T was then removed.

As the toner T, a spherical polymer toner with an average particle diameter of 5 μm was used, similar to the embodiment in FIG. 1. The heating temperature of a heater 12*a* was changed to room temperature (25° C.), 60° C., and 80° C., and the ,cleaning abilities at the respective temperatures were compared with each other. As a result, it was confirmed that the cleaning ability improved with a rise in heating temperature. More specifically, at room temperature (25° C.), i.e., when the heater 12*a* generated no heat, since a sufficient cleaning ability was not obtained only with the blade 12, a large amount of toner T remaining on the latent image charge holding member 1 after the member passed through a cleaning device 18 could be easily observed with the naked eye.

When the heating temperature of the heater 12*a* was set to be 60° C., the residual toner T could not easily be observed with the naked eye. It was confirmed that the cleaning ability improved to such an extent that a small amount of residual toner T could be observed with a microscope. In addition, when the heating temperature of the heater 12*a* was set to be 80° C. it was confirmed that the cleaning ability improved to a level at which the residual toner T could not easily be observed even with the microscope.

[Third Embodiment]

Figure 5:
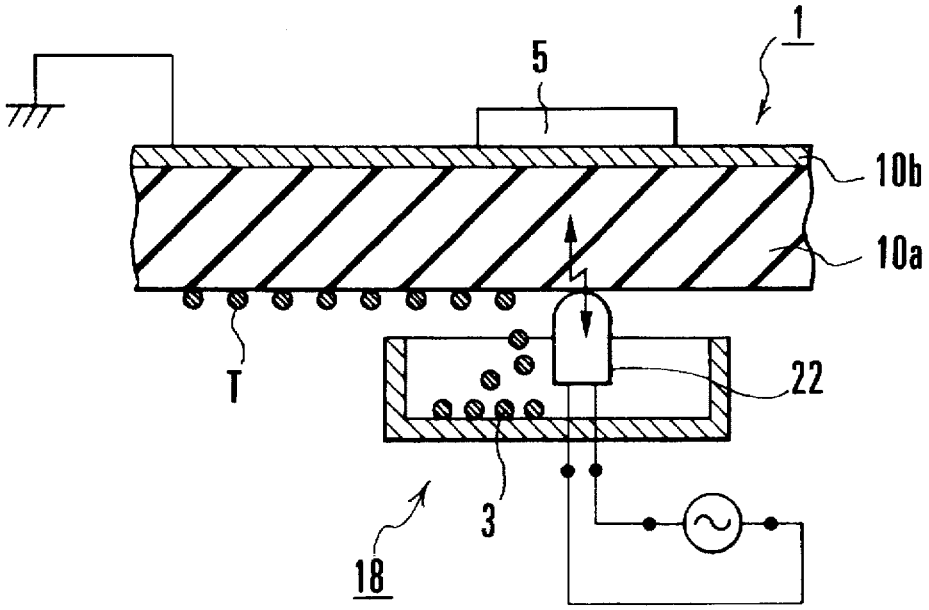
FIG. 5 is a schematic sectional view showing a cleaning device according to the third embodiment of the present invention.

FIG. 5 shows the third embodiment of the present invention. In the third embodiment, similar to the embodiment in FIG. 1, a latent image charge holding member 1 is heated by a heater 5. The third embodiment includes an ultrasonic vibrator 22 instead of the blade 2 in FIG. 1. The remaining arrangement is the same as that of the embodiment in FIG. 1.

In the third embodiment, an experiment on the removal of a toner T was conducted in the same manner as in the first embodiment. That is, the toner T was attracted to the entire surface of a latent image charge holding member 1 with an electrostatic force, and the toner T was then removed. As the toner T, a spherical polymer toner with an average particle diameter of 5 μm was used, similar to the embodiment in FIG. 1.

In this experiment, in removing the toner T, the latent image charge holding member 1 was vibrated by the ultrasonic vibrator 22 while the member was heated by the heater 5, thereby shaking the toner T off the member. When the latent image charge holding member 1 was only vibrated without being heated by the heater 5, the toner T attracted to the member could hardly be removed. As the heating temperature of the heater 5 was gradually raised, the cleaning ability improved. At about 70° C., a perfect cleaning operation could be performed.

The embodiment shown in FIG. 4 includes the heater 5 independently of the ultrasonic vibrator 22. It was, however, confirmed that the same effect as that described above could be obtained by using the ultrasonic vibrator 22 as a mechanical scraping means and heat generated by the ultrasonic vibrator 22 itself when it was continuously vibrated.

As the above heating means, other techniques can be used as long as the same function as that described above can be obtained. For example, a method of blowing hot air, a method of heating with a laser, a method of performing radiation heating with a lamp, and the like are available. As the mechanical removing means, a method using a brush or a removing means using a magnetic force, if the toner T is a magnetic toner, may be used.

[Fourth Embodiment]

Figure 6:
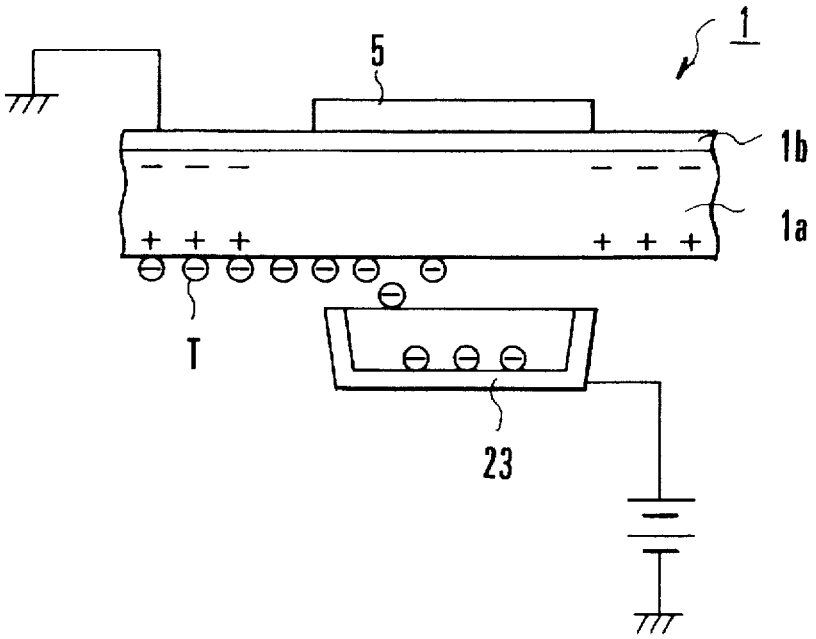
FIG. 6 is a schematic sectional view showing a cleaning device according to the fourth embodiment of the present invention.

FIG. 6 shows a cleaning device according to the fourth embodiment of the present invention. In the fourth embodiment, similar to the above embodiment in FIG. 1, a latent image charge holding member 1 is heated by a heater 5. In addition, the fourth embodiment includes an electrostatic discharging unit 23 in place of the blade 2. The remaining arrangement is the same as that of the embodiment in FIG. 1.

An experiment on the removal of a toner T was conducted in the same manner as in the first embodiment. That is, the toner T was attracted to the entire surface of the latent image charge holding member 1 with an electrostatic force, and the toner T was then removed with the electrostatic discharging unit 23 under two conditions, i.e., with and without heating by means of the heater 5. As the toner T, a spherical polymer toner with an average particle diameter of 5 μm was used.

When a cleaning operation was performed without heating by means of the heater 5, the toner T attracted to the latent image charge holding member 1 could hardly be removed. When a cleaning operation was performed while the latent image charge holding member 1 was heated to about 80° C. by the heater 5, the toner T could be easily removed from the latent image charge holding member 1.

[Fifth Embodiment]

Figure 7:
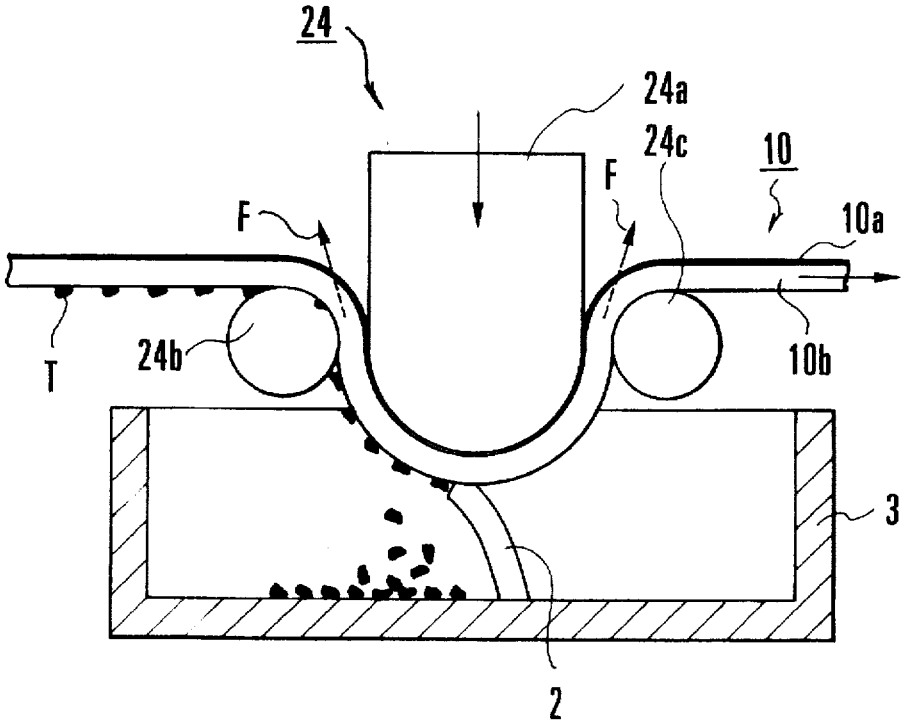
FIG. 7 is a schematic sectional view showing a cleaning device according to the fifth embodiment of the present invention.

FIG. 7 shows a cleaning device according to the fifth embodiment of the present invention. A cleaning device 18 of the fifth embodiment shown in FIG. 7 includes a stress applying mechanism 24 for mechanically distorting a latent image charge holding member 10 having piezoelectricity, a blade 2 for mechanically removing a toner T, and a cleaning case 3 for storing the toner T scraped with the blade 2.

As the latent image charge holding member 10, a film made of two layers, i.e., a pyroelectric layer 10*a* (a PVDF layer having a thickness of about 30 μm) as a piezoelectric layer and a conductive layer 10*b* (an Al deposition film having a thickness of about 500 Å) was used. This film has undergone a polarization process in such a manner that the spontaneous polarization on the pyroelectric layer 10*a* reduces, and the surface potential decreases upon application of a tension F in the direction indicated by reference symbol F in FIG. 7.

The stress applying mechanism 24 is constituted by a press member 24*a* which comes into contact with the latent image charge holding member 10 as if crossing the member, and guide rollers 24*b* and 24*c* disposed on two sides of the press member 24*a*. The guide rollers 24*b* and 24*c* are disposed on two sides of the press member 24*a* through the latent image charge holding member 10 with this structure, the latent image charge holding member 10 is set in a depressed state with a portion of the stress applying mechanism 24, as shown in FIG. 7. The remaining arrangement is the same as that of the embodiment in FIG. 1.

The operation of the fifth embodiment in FIG. 7 will be described next.

When the latent image charge holding member 10 is mechanically distorted, the oriented state of molecules can be changed as in the case wherein the pyroelectric effect is used. By using this, therefore, the polarization charges on the surface of the latent image charge holding member 10 can be reduced.

More specifically, as shown in FIG. 7, in mechanically removing the toner T with the blade 2, the stress applying mechanism 24 mechanically distorts the latent image charge holding member 10 to reduce the attraction between the toner T and the latent image charge holding member 10, thereby allowing easy removal of the toner T from the ,latent image charge holding member 10. A substance having pyroelectricity also has piezoelectricity. The latent image charge holding member 10 having the pyroelectric layer 10*a* like the one in the embodiment in FIG. 1 is therefore used in such a manner that a pyroelectric effect is used for the formation of a latent image, and piezoelectricity is used for cleaning the non-transferred toner T to easily remove the toner T from the latent image charge holding member 10.

An experiment on the removal of the toner T was conducted in the same manner as in the first embodiment. That is, the spherical polymer toner T with an average particle diameter of 5 μm was attracted to the entire surface of the latent image charge holding member 10 with an electrostatic force, and the toner T was then removed. In this experiment, the latent image potential of the latent image charge holding member 10 was set to be 300 V before the charged toner T was attracted to the entire, surface of the latent image charge holding member 10, and a tension to be applied to the latent image charge holding member 10 was adjusted such that the surface potential of the latent image charge holding member 10 decreased by 250 V upon application of the tension.

In order to check the effect of the cleaning device of the fifth embodiment, cleaning abilities in the following two cases were compared with each other. In the first case, a cleaning operation was performed with the blade 2 while the tension F was applied from the stress applying mechanism 24 to the latent image charge holding member 10, as shown in FIG. 7. In the second case, a cleaning was performed without applying any tension.

After the cleaning operation without any tension, a large amount of toner T remaining on the latent image charge holding member 10 could be observed with the naked eye. After the cleaning operation using the blade 2 with the tension F, almost no residual toner T could be observed not only with the naked eye but also with a microscope.

It was confirmed that the cleaning ability could be greatly improved when a cleaning operation was performed while the latent image charge holding member 10 having the pyroelectric layer 10*a* was mechanically distorted.

In the above embodiment, the blade 2 is used as a scraping mechanism. However, the same effect as described above can be obtained by using a brush, ultrasonic vibrations, a magnetic force, or the like.

Although no heater is used in the above embodiment, a heater for heating the latent image charge holding member 10 may be used, together with the stress applying mechanism 24. In addition, as the press member 24*a* of the stress applying mechanism 24, an ultrasonic vibrator for vibrating the latent image charge holding member 10 while pressing it may be used. In this case, the blade 2 can be omitted.

With the above arrangement and function of the present invention, since the pyroelectric layer is heated in removing a toner, the attraction between the toner and the latent image charge holding member can be greatly reduced. Therefore, there is provided a cleaning device, superior to the conventional cleaning devices, which can reliably remove the residual charged toner from the latent image charge holding member with high precision, thereby improving the overall reliability of the apparatus.

What is claimed is:

1. A cleaning device for a piezoelectric layer having a first surface on which a toner is disposed by an electrostatic force, said cleaning device comprising:

removing means adapted for removing said toner held on said first surface of said piezoelectric layer; and distorting means for mechanically distorting said piezoelectric layer by pressing said piezoelectric layer between a pair of members to reduce said toner holding force of said piezoelectric layer, said removing means removing the toner from a portion of said piezoelectric layer which is distorted by said distorting means.

2. A device according to claim 1, further comprising a cleaning case for storing the toner removed by said removing means.

3. A device according to claim 1, wherein said distorting means comprises a distorting mechanism, disposed approximately midway along a traveling path of said piezoelectric layer in correspondence with said removing means, for bending and guiding said piezoelectric layer, which is distorted in the form of a narrow U shape.

4. A device according to claim 1, wherein said distorting means comprises an ultrasonic vibrator for vibrating said piezoelectric layer while pressing said piezoelectric layer.

5. A device according to claim 1, wherein said removing means comprises a blade which is brought into contact with the first surface of said piezoelectric layer distorted by said distorting means to mechanically scrape the toner from said piezoelectric layer whose toner holding force is reduced.

6. A device according to claim 1, wherein said piezoelectric layer on which said device operates is a pyroelectric member.

7. A device according to claim 6, wherein said piezoelectric layer is a portion of a latent image charge holding member.

* * * * *